United States Patent [19]

Diemer et al.

[11] 4,413,499

[45] Nov. 8, 1983

[54] ROLLING KEY LOCK FOR FORGING DIE AND PRESS

[76] Inventors: Donald J. Diemer, 4355 Brendan La., North Olmsted, Ohio 44070; Ralph D. Delio, R.D. #1 Susan Trace, New Wilmington, Pa. 16142

[21] Appl. No.: 311,004

[22] Filed: Oct. 13, 1981

[51] Int. Cl.[3] ..... B21J 13/00

[52] U.S. Cl. ..... 72/446; 72/441; 72/442; 72/448; 83/698; 403/323

[58] Field of Search ..... 72/448, 464, 446, 441, 72/442, 445; 83/698; 100/DIG. 18, 224; 403/323, 379

[56] References Cited

U.S. PATENT DOCUMENTS

| | | | |
|---|---|---|---|
| 1,408,993 | 3/1922 | Eberhardt . | |
| 1,458,244 | 6/1923 | Reeves et al. . | |
| 1,569,136 | 1/1926 | Pardee | 83/698 |
| 2,138,106 | 11/1938 | Klocke | 72/445 |
| 2,342,021 | 2/1944 | Swanson | 78/9 |
| 2,377,191 | 5/1945 | Teachout | 113/49 |
| 2,526,918 | 10/1950 | Wilberschied | 22/92 |

*Primary Examiner*—Lowell A. Larson
*Assistant Examiner*—David B. Jones
*Attorney, Agent, or Firm*—Fay & Sharpe

[57] ABSTRACT

Disclosed is a forging press including an automatic rolling key die lock comprising a forging ram and a forging frame including a die socket with an inner sidewall slot. A die, preferably comprising a split ring die, is received in the die socket and includes a mating slot for mating alignment with the press sidewall slot. A rolling key is received in the sidewall slot and the mating slot comprising an elongated bar including an intermediate undercut portion and a connecting member eccentrically secured to one terminal end of the bar. A lever is operatively engaged at one end to the connecting member for rotation of the rolling key upon selective operation of the lever, and operatively engaged at a second end to the ram for operation of the lever upon selective advancement and retraction of the ram.

12 Claims, 8 Drawing Figures

ROLLING KEY LOCK FOR FORGING DIE AND PRESS

BACKGROUND OF THE INVENTION

This invention pertains to the art of locking devices and, more particularly, to an automatically operated locking device for a forging press and die. However, it will be appreciated to those skilled in the art that the invention could be readily adapted for use in other environments as, for example, where similar locking devices are employed in locking components of other types of machinery.

Conventional forging presses utilizing a ram and plunger for forging ingots or billets into desired shapes must use a great force to deform the billet. Most presses use dies which are selectively insertable into the press and are of various configurations depending upon the desired shape of the article of manufacture. It is particularly important that the dies be securely set into the press frame to avoid shifting or movement of the dies when they are subjected to the heavy pressure forces. Shifting or movement will cause unacceptable products.

Various forms and types of locking devices have heretofore been suggested and employed in the industry, all with varying degrees of success. It has been found that the defects present in most prior forging die and press locking devices are such that the devices are of limited economic and practical value.

Typically, these prior die locking devices have variously comprised fastening members such as threaded bolts, secured clamps or vice jaws and locking pins.

Prior die locking devices have suffered a number of inherent problems. The time required to install and secure these prior locking devices is often particularly lengthy in comparison to the time for operation of the forging press itself. In those manufacturing circumstances where it would be desirable to readily remove or interchange dies, prior secured die locking devices make such manufacturing methods uneconomical and impractical. A substantial portion of usable forging time would be consumed by the insertion, securing, unsecuring, and removal of the dies.

A further problem with forging presses using substantially fixed die locking devices is jamming of a forged workpiece in the die. Oftentimes jamming of the workpiece results in extremely costly interruption of the manufacturing operation and necessary replacement of the die. Frequently, power ejectors are used for removal of the workpiece, and where jamming has occurred, power ejecting can mar or damage both the workpiece and the die.

A further problem with prior art devices concerns the handling of a workpiece. In those manufacturing operations where it would be advantageous to handle the workpiece with a member secured to the workpiece during the forging operation, such as a readily removable die, the prior art devices have been totally unacceptable due to the substantially fixed nature of the dies and the workpiece supporting members.

The present invention contemplates a new and improved device which overcomes all of the above referred to problems and others to provide a new rolling key locking device for a split ring forging die and press which is simple in design, economical to manufacture, readily adaptable to a plurality of uses with dies having a variety of dimensional characteristics, easy to install, easy to remove, easy to operate and which provides improved and expedited handling of forgings from a press.

BRIEF SUMMARY OF THE INVENTION

In accordance with the present invention, there is provided a rolling key for locking a die in a forging press comprising a first section including an intermediate portion of a reduced span, and a second section secured to and axially offset from the first section. The second section is adapted for attachment to a lever whereby upon selective movement of the lever, the rolling key is rotated for selective locking and unlocking of the die in the forging press.

In accordance with another aspect of the present invention, the first section is generally cylindrical in form throughout the major portion of its length, and the intermediate portion of reduced span comprises a squared undercut.

In accordance with the present invention, there is provided a press including a die lock. The press comprises a frame including a die socket having a sidewall slot; a ram including a plunger; a split ring die received in the die socket and including a mating slot disposed for mating alignment with the sidewall slot; a rolling key received in the sidewall slot and the mating slot comprising an elongated bar including an intermediate undercut portion, and a connecting member eccentrically secured to one terminal end of the bar; and a lever. One end portion of the lever is operatively engaging the connecting member for rotation of the rolling key upon selective operation of the lever. A second end portion of the lever operatively engages the ram for operation of the lever upon selective advancement and retraction of the ram.

In accordance with another aspect of the present invention, the undercut portion is at least axially extensive of the elongated bar to the extent of the mating slot of the die.

In accordance with a further aspect of the present invention, the undercut portion is disposed radially inward of the die socket at full retraction of the ram from the die socket and is disposed for partial filling of the mating slot of the split ring die during advancement of the plunger into the die.

In accordance with the present invention, there is provided a method of forging comprising the steps of inserting a billet into a die in a die socket of a forging press; advancing a plunger of a ram of the press into the billet; rotating a rolling key including an undercut portion in a tangential slot of the die to a first position to lock the die in the die socket during advancement of the plunger; retracting the plunger from the billet; rotating the rolling key to a second position to unlock the die during retraction of the plunger; and, removing the forged billet and the die from the die socket.

In accordance with another aspect of the present invention, the step of rotating a rolling key to lock the die comprises operating a lever pivotally secured to the die socket at one end, operatively engaged to the ram at the other end, and connected to a connecting member eccentrically connected to an elongated bar including the undercut portion during advancing the plunger to cause rotation of the connecting member and the elongated bar to the first position.

In accordance with yet another aspect of the present invention, the step of rotating the rolling key to unlock the die comprises operating the lever during retracting of the plunger to cause rotation of the connecting member and the elongated bar to the second position to dispose the undercut portion in the tangential slot of the die.

One benefit obtained by use of the present invention is a forging die utilizing a rolling key lock which offers ready insertion and removal of various dies.

Another benefit obtained from the present invention is a rolling key lock for a forging die which automatically locks a die in a die socket during advancement of a plunger into the die socket and automatically releases the die during retraction of the plunger from the die socket to aid in ready removal of the forging and the die.

A further benefit of the present invention is a forge which allows handling of a forging with a split ring removable die.

Other benefits and advantages for the subject new rolling key lock for a forging die will become apparent to those skilled in the art upon a reading and understanding of this specification.

BRIEF DESCRIPTION OF THE DRAWINGS

The invention may take physical form in certain parts and arrangement of parts, the preferred embodiment of which will be described in detail in the specification and illustrated in the accompanying drawings which form a part hereof and wherein.

DETAILED DESCRIPTION OF THE INVENTION

Figure 1:
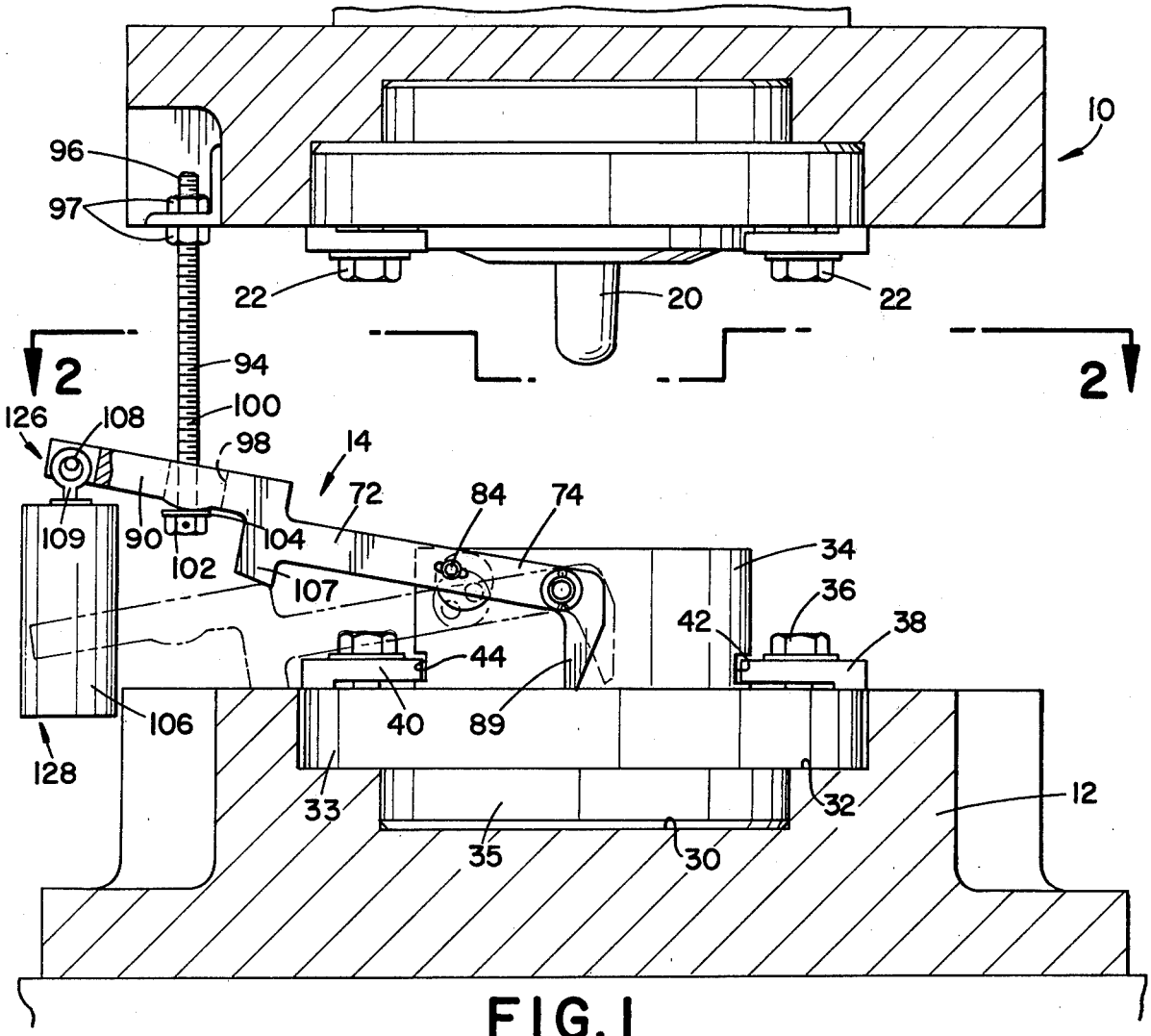
FIG. 1 is an elevational view in partial section of a forging press formed in accordance with the present invention showing the rolling key in a first unlocking position and, in dashed lines, a second locking position.

Referring now to the drawings where the showings are for purposes of illustrating the preferred embodiment of the invention only and not for purposes of limiting same, the FIGURES show a forging press including a rolling key lock comprised of a ram 10, a base 12, and a die locking device 14.

Figure 2:
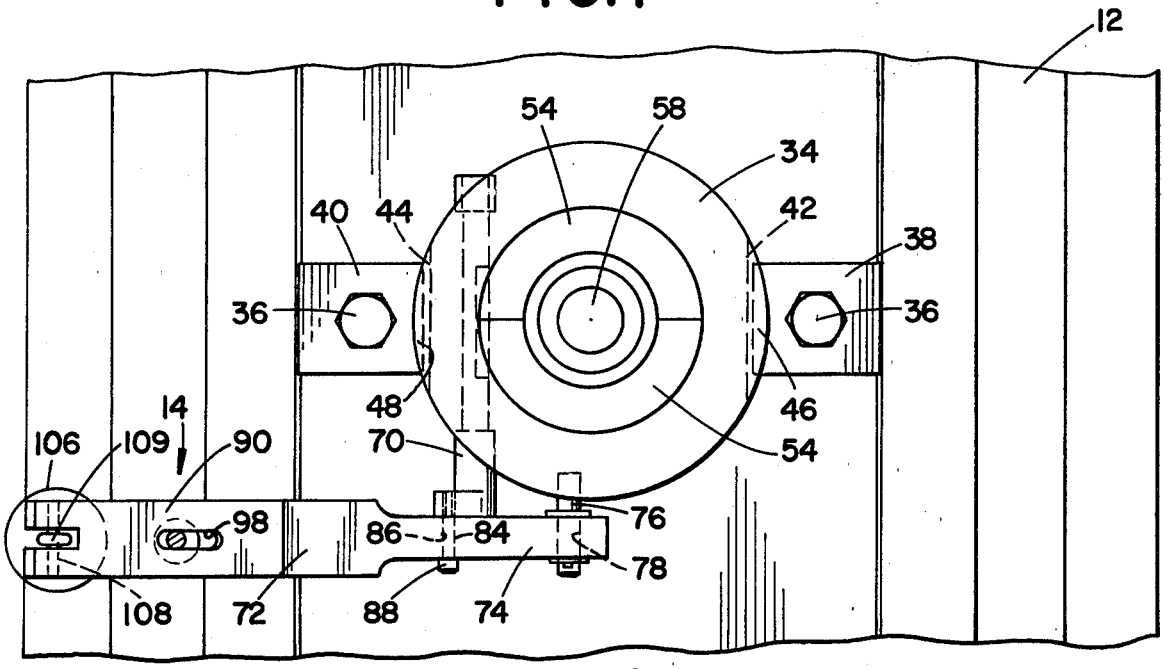
FIG. 2 is a plan view taken along line 2—2 of FIG. 1.

More specifically and with reference to FIGS. 1 and 2, ram 10 is of a generally conventional configuration and is mounted on a frame (not shown) for selective advancement into and retraction from base 12. Ram 10 includes a plunger, punch or piercing tool 20 which is securely fastened to the ram 10 by means of conventional fastening means such as threaded bolts 22.

Base 12 is also of conventional configuration and includes axially aligned recesses 30, 32 configured to receive a die socket 34 and die socket support members 33, 35. Die socket 34 is securely fastened to base 12 with conventional fastening means such as threaded bolts 36 and securing clamps 38, 40 to base 12. Outer sidewall cavities 42, 44 of die socket 34 receive clamp end portions 46, 48 respectively, and die socket 34 is thereby fastened to base 12.

Figure 3:
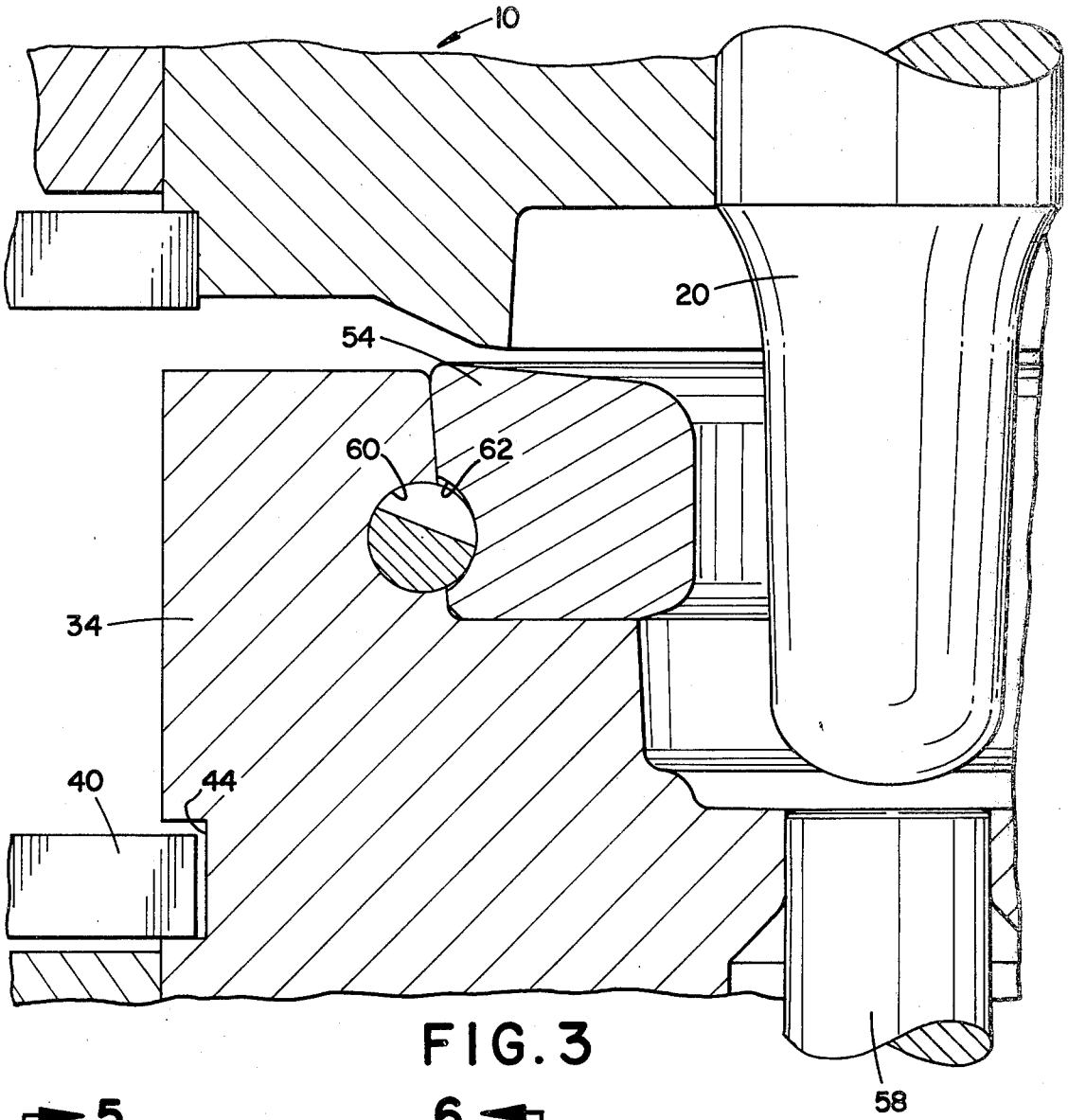
FIG. 3 is an enlarged cross-sectional view of a portion of a forging press formed in accordance with the present invention showing the rolling key in locking engagement with a split ring die in a die socket during advancement of the forging plunger into the workpiece in the die.

With particular reference to FIGS. 2 and 3, a set of lockable split ring dies 54 is received in die socket 34. A centrally disposed, powered ejector piston 58 is centrally disposed for ejecting workpieces from the die during operation of the press. Dies 54 are illustrated as circular dies such as are typical in manufacturing flanged items such as hubs or the like, but it is within the scope of the invention to utilize an alternately configured die socket or alternately configured die such as square or rectangular configurations without departing from the spirit of the invention.

Die socket 34 includes an inner sidewall slot 60 and split ring dies 54 include an outer sidewall, tangential, mating slot 62 disposed for mating alignment with die cavity sidewall slot 60. Preferably, slots 60, 62 are arcuate in cross-sectional configuration and mate to form a generally cylindrical, transverse bore of die socket 34 and split ring dies 54.

With particular reference to FIGS. 1 and 2, die locking device 14 is principally comprised of a rolling key 70 and a connected lever 72. Lever 72 is pivotally connected to an outer sidewall of die socket 34 at lever one end portion 74 by means of a conventional pivot connection, such as pin 76 received in a pivot pin bore 78.

Lever one end portion 74 is also operatively engaged to rolling key 70. Engaging means such as a conventional threaded fastener 84 loosely received in a first fastener slot 86 are preferably employed. Fastener 84 is configured for axial movement of lever 72 in slot 86 during operation of lever 72 (FIG. 7) and includes a head 88 dimensioned so as to be unable to pass through slot 86 and such that when fastener 84 is threaded into rolling key 70 a close abutting relationship is maintained between rolling key 70 and lever 72. A one end portion shoulder 89 is provided for abutting die cavity support member 33 when lever 72 is in a raised position.

Second end portion 90 of lever 72 is operatively engaged to ram 10 similarly with a conventional threaded fastener 94 securing fastened at one end 96 to ram 10 with threaded nuts 97 and loosely received in a second fastener slot 98 at the fastener other end 100. The second fastener slot 98 is dimensioned to allow axial movement of lever 72 by second fastener 94 during operation of lever 72 (FIG. 2). The head 102 of second fastener 94 is configured, or includes a washer 104, to prevent the lever 72 from becoming disengaged to the fastener 94. Preferably, the second end portion 90 is also counterweighted with counterweight 106 to bias lever 72 against the head 102 of second fastener 94 during operation of the press. Counterweight connection means such as pin 108 through lock 109 can be advantageously employed. A second end portion shoulder 107 is provided for abutting base 12 when lever 72 is in a lowered position.

Figure 4:
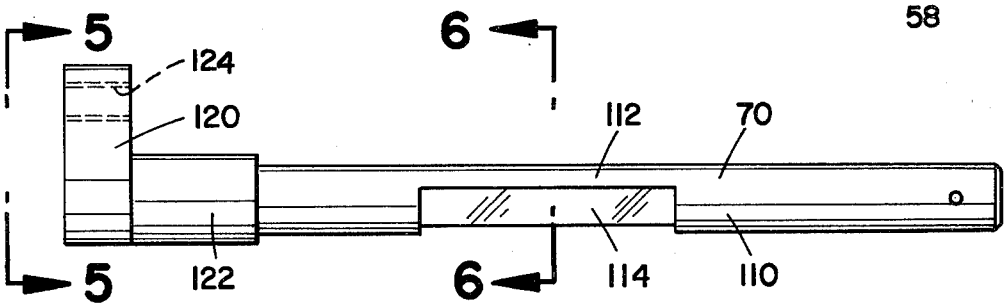
FIG. 4 is an elevational view of a rolling key formed in accordance with the present invention.
Figure 5:
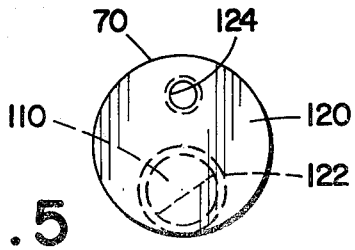
FIG. 5 is an elevational view taken along line 5—5 of FIG. 4.
Figure 6:
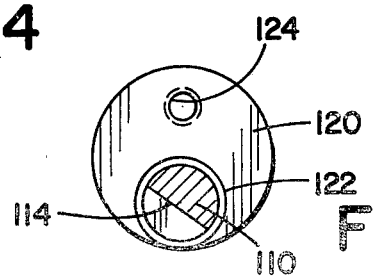
FIG. 6 is an elevational view in partial section taken along line 6—6 of FIG. 4.

With particular reference to FIGS. 4, 5 and 6, rolling key 70 is shown as preferably comprising an elongated bar generally cylindrical in form throughout the major portion of its length. A first section 110 of key 70 includes an intermediate portion of reduced cross-section span 112. A squared undercut portion 114 is preferably employed for reduced span, although other configurations could similarly be usefully employed. The axial extent of undercut 114 is at least equivalent to the extent of mating slot 62 of split ring dies 54 such that dies 54 may pass key 70 when undercut 114 faces mating slot 62, as will be explained in greater detail hereafter. A second section 120 of key 70 is secured to a third section 122 which is attached to first section 110 by conventional attachment means. Second section 120 and third section 122 are preferably of a generally cylindrical configuration and second section 120 is axially offset from third section 122 and first section 110 such that second section 120 is eccentrically disposed to sections 110, 122. Second section 120 includes a threaded bore 124 for tightly receiving fastener 84 (FIG. 2) for fastening the key 70 to lever 72.

OPERATION

With particular attention to FIGS. 1, 3, 7 and 8, the improved operating characteristics of the new forging press and die with rolling key lock will be specifically discussed.

Figure 7:
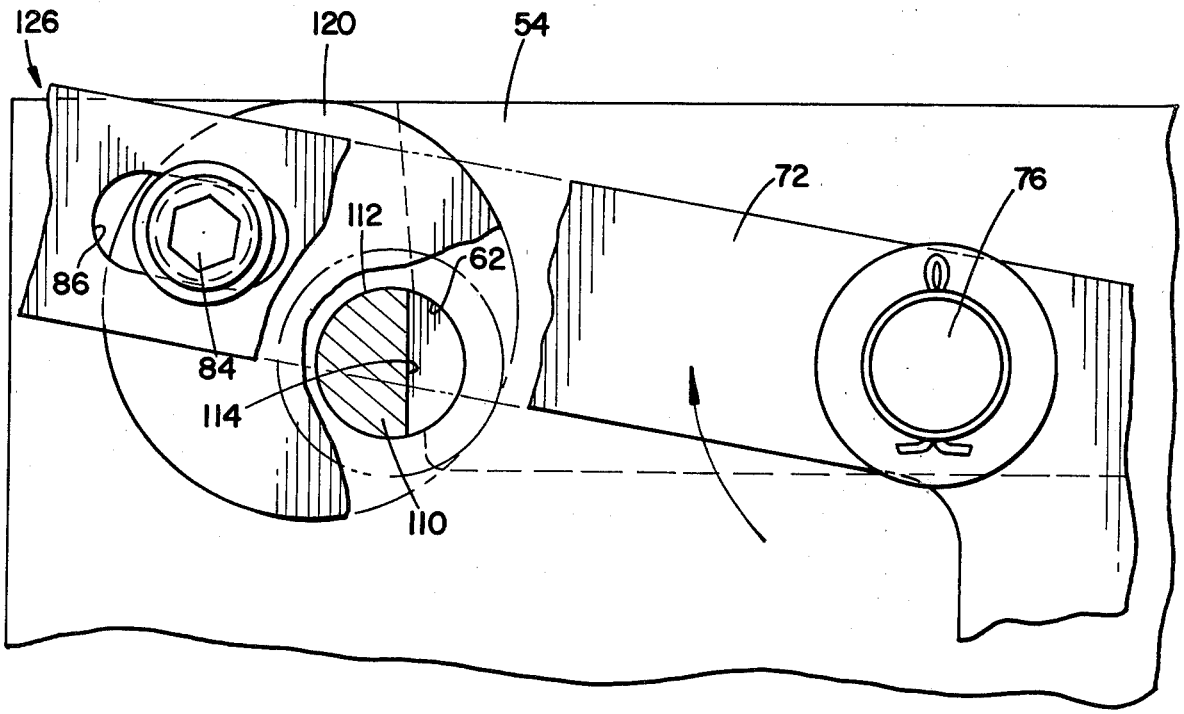
FIG. 7 is an enlarged partial cross-sectional view of a portion of FIG. 1 showing the rolling key in a die unlocking position.
Figure 8:
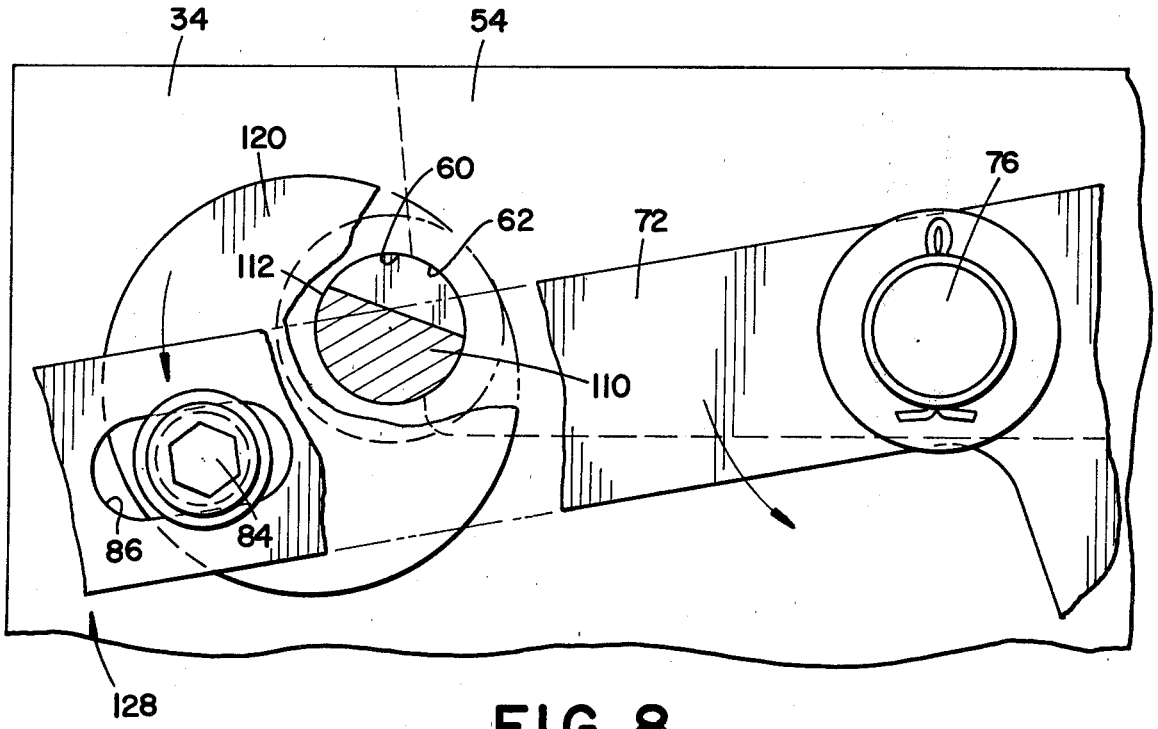
FIG. 8 is an enlarged partial cross-sectional view of a portion of FIG. 1 showing the rolling key in a die locking position.

A workpiece (not shown) typically comprising a billet is inserted into die socket 34 with a loose abutting relationship against lockable split ring dies 54. Plunger 20 is advanced into the die socket 34 and the workpiece for deforming the workpiece into the configuration of the inner walls of the dies. As ram 10 is advanced and lowered, lever 72 is correspondently lowered from a first position 126 to a second position 128 by completion of the advancing stroke. With particular reference to FIG. 8, it can be seen that as lever 72 is lowered, second section 120 is rotated and first section 110 of key 70 is associatively rotated in slots 60, 62 such that the reduced span portion 112 of key first section 110 at least partially occupies mating slot 62 of dies 54. During partial filling or occupation of slot 62 by rolling key 70, lockable dies 54 are locked in die socket 34. The workpiece is thus forged in conformance with the inner sidewall surfaces of the dies without shifting or movement of the dies. The plunger 20 may then be retracted from die cavity 34 by raising ram 10 and consequently raising lever 72. With particular reference to FIG. 7, when lever 72 is raised to first position 126, first section 110 of rolling key 70 is rotated such that reduced span portion 112 is disposed so that undercut 114 is directed substantially radially inward of dies 54 to prevent occupation of slot 62 by any portion of key 70. Dies 54 may then be easily removed from die socket 34 for replacement or for use in handling the workpiece. It should be noted that the locking and releasing of dies 54 is controlled by the advancement and retraction of ram 10 and the consequent movement of lever 72.

The invention has been described with reference to the preferred embodiment. Obviously, modifications and alterations will occur to others upon the reading and understanding of the specification. It is our intention to include all such modifications and alterations insofar as they come within the scope of the appended claims or the equivalents thereof.

Having thus described the invention, we now claim:

1. A forging press including a die lock comprising:

a forging base including a die socket, said socket having an inner sidewall slot;

a ram including a plunger;

a die received in said die socket and including a mating slot disposed for mating alignment with said sidewall slot;

a rolling key received in said sidewall slot and said mating slot comprising an elongated bar including an intermediate undercut portion, and a connecting member eccentrically secured to one terminal end of said bar; and a lever, one end portion of said lever operatively engaging said connecting member for rotation of said rolling key upon selective operation of said lever, and a second end portion of said lever operatively engaging said ram for operation of said lever upon selective advancement and retraction of said ram.

2. The press as described in claim 1 wherein said undercut portion is at least axially extensive of said elongated bar to the extent of said mating slot of said die.

3. The press as described in claim 2 wherein said undercut portion is disposed radially inward of said die socket at full retraction of said ram from said die socket.

4. The press as described in claim 3 wherein said rolling key is disposed for at least partial filling of said mating slot of said die during advancement of said plunger into said die.

5. The press as described in claim 1 wherein said connecting member is generally cylindrical in form and includes an axially offset threaded bore for receiving means for fastening said lever one end portion to said connecting member.

6. The press as described in claim 1 wherein a first terminal end portion of said lever one end portion is pivotally fastened to an outer sidewall of said die socket.

7. The press as described in claim 6 wherein a second terminal end portion of said lever second portion is connected to means for counterweighing said lever.

8. The press as described in claim 7 wherein said second end portion of said lever includes a radial bore for loosely receiving means for operatively engaging said ram to said lever.

9. The press as described in claim 8 wherein said means for operatively engaging said ram to said lever comprises a selectively adjustable threaded member fastened at one end to said ram and including a second end configured for abutting engagement to said lever during advancement and retraction of said plunger from said die socket.

10. A method of forging comprising the steps of:

(a) inserting a billet into a die in a die socket of a forging press;

(b) advancing a plunger of a ram of said forging press into said billet;

(c) rotating a rolling key including an undercut portion in a tangential slot of said die to a first position to lock said die in said die socket during advancement of said plunger;

(d) retracting said plunger from said billet;

(e) rotating said rolling key to a second position to dispose said undercut portion to unlock said die during retraction of said plunger; and, (f) removing said forging billet and said die from said die socket.

11. The method as described in claim 10 wherein said step of rotating a rolling key lock said die comprises operating a lever pivotally secured to said die socket at one end, operatively engaged to said ram at the other end, and connected to a connecting member eccentrically connected to an elongated bar including said undercut portion, during advancing said plunger to cause rotation of said connecting member and said elongated bar to said first position.

12. The method as described in claim 11 wherein said step of rotating said rolling key to unlock said die comprises operating said lever during retracting of said plunger to cause rotation of said connecting member and said elongated bar to said second position to dispose said undercut portion in said tangential slot of said die.

* * * * *